US011719437B2

(12) United States Patent
Bortoliero et al.

(10) Patent No.: US 11,719,437 B2
(45) Date of Patent: Aug. 8, 2023

(54) SYSTEM AND METHOD FOR OPERATIONAL CONTROL OF A WATER HEATER APPARATUS WITH A COMBUSTIBLE GAS BURNER

(71) Applicant: SIT S.p.A., Padua (IT)

(72) Inventors: Michele Bortoliero, Monselice (IT); Massimo Giacomelli, Venice (IT); Giancarlo Pirovano, Martellago (IT)

(73) Assignee: SIT S.P.A., Padua (IT)

( * ) Notice: Subject to any disclaimer, the term of this patent is extended or adjusted under 35 U.S.C. 154(b) by 222 days.

(21) Appl. No.: 17/128,443

(22) Filed: Dec. 21, 2020

(65) Prior Publication Data

US 2021/0190316 A1 Jun. 24, 2021

(30) Foreign Application Priority Data

Dec. 23, 2019 (IT) ..... 102019000025351

(51) Int. Cl.

| | |
|---|---|
| ***F23Q 9/14*** | (2006.01) |
| ***F23N 1/00*** | (2006.01) |
| ***F24D 19/10*** | (2006.01) |
| ***F24H 9/20*** | (2022.01) |
| *F24H 1/18* | (2022.01) |

(52) U.S. Cl.

CPC ..... *F23Q 9/14* (2013.01); *F23N 1/005* (2013.01); *F24D 19/1051* (2013.01); *F24H 9/2035* (2013.01); *F23N 2229/00* (2020.01); *F24H 1/186* (2013.01)

(58) Field of Classification Search

CPC . F23N 5/12; F23N 5/123; F23N 1/002; F23N 1/005; F23N 2229/00; F23N 2227/36; F23N 5/242; F23N 2231/06; F23N 2229/12; F23N 5/203; F23Q 9/14;

(Continued)

(56) References Cited

U.S. PATENT DOCUMENTS 3,395,968 A 8/1968 Mobarry et al.
5,720,604 A * 2/1998 Kelly ..... F23N 5/123 340/579

(Continued)

FOREIGN PATENT DOCUMENTS

JP 2012097925 5/2012
WO 2019224128 A1 11/2019

*Primary Examiner* — Ko-Wei Lin
(74) *Attorney, Agent, or Firm* — Volpe Koenig

(57) ABSTRACT

A control system of a water heater apparatus with a combustible gas burner is presented where the apparatus includes a pilot burner with an intermittent-type pilot flame, a main burner, a pilot valve and a main valve, a control unit, a flame detection electrode, introduced into the flame of the pilot burner, and which is configured to conduct an ionization current. The control unit is configured to measure/detect a variation involving increase/decrease of the intensity of ionization current detected, the variation in intensity of ionization current being generated during the change between a first condition, in which the ionization current identifies the ignition state of only the pilot burner, and a second condition, in which the ionization current identifies the simultaneous ignition state of the pilot burner and the main burner so that, by detection of the measurement/variation of ionization current, the effective ignition of the main burner is recognized.

10 Claims, 4 Drawing Sheets

(58) Field of Classification Search
CPC ..... F23Q 3/00; F23Q 9/12; F24D 19/1051; F24H 9/2035
USPC ..... 122/14.1; 431/24–25
See application file for complete search history.

(56) References Cited

U.S. PATENT DOCUMENTS

| | | | | |
|---|---|---|---|---|
| 7,568,909 | B2 * | 8/2009 | MacNutt | F23N 5/00 431/74 |
| 2014/0199641 | A1 * | 7/2014 | Chian | F23Q 7/26 431/28 |
| 2018/0172316 | A1 * | 6/2018 | Smelcer | F24H 9/2035 |
| 2019/0162408 | A1 * | 5/2019 | Eadie | F23N 5/24 |
| 2019/0338987 | A1 * | 11/2019 | Young | F24H 9/1836 |

* cited by examiner

SYSTEM AND METHOD FOR OPERATIONAL CONTROL OF A WATER HEATER APPARATUS WITH A COMBUSTIBLE GAS BURNER

TECHNICAL FIELD

The present invention relates to a system for operational control of a water heater apparatus with a combustible gas burner and a method for controlling the apparatus.

The system according to the invention is used particularly, though not exclusively, in the technical sector of sanitary water heater apparatuses for water heater storage systems in which there is provision for using a pilot burner with intermittent type control, or in which the pilot flame is ignited or extinguished depending on whether or not there is a requirement for heat which brings about the ignition of the main burner.

BACKGROUND

This type of apparatuses typically has other specific characteristics, for example, it is provided with an electronic flame control (constructed with the signal detected by an electrode introduced in the pilot flame and sent to the control unit of the apparatus), it is configured in such a manner that, when the temperature of the water required is reached (Tset), the control unit sends a simultaneous extinguishing instruction for the main burner and the pilot burner, it is typically provided with a thermostat of the ON/OFF type or the modulation type for controlling the ignition and extinguishing of the main and pilot burners and it is further provided with a safety device to prevent over-temperatures. This device is normally configured to intervene when the temperature of the water reaches a limit temperature, placing the apparatus in a condition preventing use.

In these apparatuses, the logic of the control unit is further carried out in a printed circuit board which regulates the control of the pilot valve and the main valve, both the valves being configured as electrical control valves (solenoid valves).

In the present context, unless otherwise specified, therefore, the terms "main valve" and "pilot valve" are intended to be understood to refer to the respective valve configurations which are provided with electric control.

This type of apparatuses has the advantage of providing for ignition of the automatic type. Furthermore, it has a greater energy efficiency than the apparatuses provided with a continuous pilot because the pilot burner remains lit only for the time required to ignite the main burner and as long as the main burner is ignited, but, in the event of the main burner being switched off, the pilot burner is also switched off.

Nowadays, in water heater apparatuses with an intermittent pilot of storage water heater systems, it is known to provide for the flame to be detected only at the pilot burner. The reference standard for such a type of apparatuses requires that, as long as the system is capable of detecting the presence of flame at the pilot burner, this flame has to be capable of igniting the main burner within a few seconds from the opening of the main gas valve.

In these apparatuses, detecting the effective ignition state of the main burner may be of particular importance in order to identify and control possible faults or malfunctions at the main valve. A possible solution in order to detect the effective ignition of the main burner may provide for the use of a second electrode with a second flame detector being associated. However, using this additional electrode associated with a flame detector corresponding to the main burner involves a greater complexity of the system with a resultant significant increase in costs.

The failure to close the main valve is particularly dangerous in the systems of the type described, which are provided with an intermittent pilot. In these systems, in fact, when the temperature value required (Tset) is reached, both the main valve and the pilot valve are closed and therefore the flow of gas is interrupted both to the pilot burner and to the main burner. Then, when the temperature regulator requests the ignition of the burner (normally carried out with the ignition of the pilot burner following the ignition of the main burner), opening the pilot valve starts the flow of the gas both to the pilot and to the main burner, with the risk of an explosion at the time of the sparking of the flame of the pilot burner. Any combustible gas detectors in the combustion chamber are found to be substantially ineffective because the closure of the pilot valve causes the interruption of the gas flow.

In other words, in the event of a malfunction of the main valve, the extinguishing of the pilot burner with the closure of the pilot valve brings about a situation which is potentially dangerous for the subsequent ignition of the same pilot burner because the pilot valve being opened also allows the flow of the gas towards the main burner with a possible risk of an explosion, and this risk is particularly emphasized in the systems with an intermittent pilot burner.

SUMMARY

A main object of the present invention is to provide a system and a method for the operational control of a water heater apparatus with a combustible gas burner provided with an intermittent pilot, which are configured to overcome the limitations set out with reference to the cited prior art.

This object is achieved by means of a system and a method for the operational control of a water heater apparatus with a combustible gas burner which are constructed according to the respective independent claims appended.

According to a first aspect of the invention, there is provided a system for operational control of a water heater apparatus with a combustible gas burner, the apparatus comprising a pilot burner for generating a pilot flame, a main burner for generating a main flame, a valve group comprising a pilot valve upstream of the pilot burner in order to open/intercept a direct flow of gas to the pilot burner and to a main valve, the main valve being positioned upstream of the main burner in order to open/intercept a direct flow of gas to the main burner, the pilot valve and main valve being electrical control valves, the pilot burner being controlled as a burner with a pilot flame of the intermittent type, the control system comprising a control unit which is operationally associated with the pilot valve and main valve for the operational control thereof, a flame detection electrode which is provided to be introduced into the flame of the pilot burner and which is configured to conduct an ionization current which is generated by ionizing effect produced by the flame, wherein the control unit is configured to carry out a measurement or to detect a variation involving increase or decrease of the intensity of ionization current detected in the electrode, the variation in intensity of ionization current being generated during the change between a first condition, in which the ionization current identifies the ignition state of only the pilot burner, and a second condition, in which the ionization current identifies the simultaneous ignition state of the pilot burner and the main burner so that, by means of the detection of the measurement or the variation of ionization current, the effective ignition of the main burner is recognized.

According to another aspect of the invention, the control unit is configured to detect the measurement of intensity of the ionization current so that there can be recognized the first ignition condition of only the pilot burner identified by a first range of values of intensity of ionization current and the second ignition condition of the pilot burner and the main burner identified by a second range of values of intensity of ionization current, the first and second ranges being mutually different so that the state of effective ignition of only the pilot burner can be distinguished from the simultaneous ignition state of the main burner and the pilot burner.

According to another aspect of the invention, the control unit is configured to introduce a delay time between the closure instruction sent to the main valve and the closure instruction sent to the pilot valve, during the delay time the ionization current being measured or a variation thereof being detected in order to identify the effective extinguishing of the main burner.

Preferred features of the invention are defined in the dependent claims.

BRIEF DESCRIPTION OF THE DRAWINGS

Additional features and advantages of the invention will be better appreciated from the following detailed description of a preferred embodiment thereof which is illustrated by way of non-limiting example with reference to the appended Figures, in which.

DETAILED DESCRIPTION OF THE PREFERRED EMBODIMENTS

Figure 1:
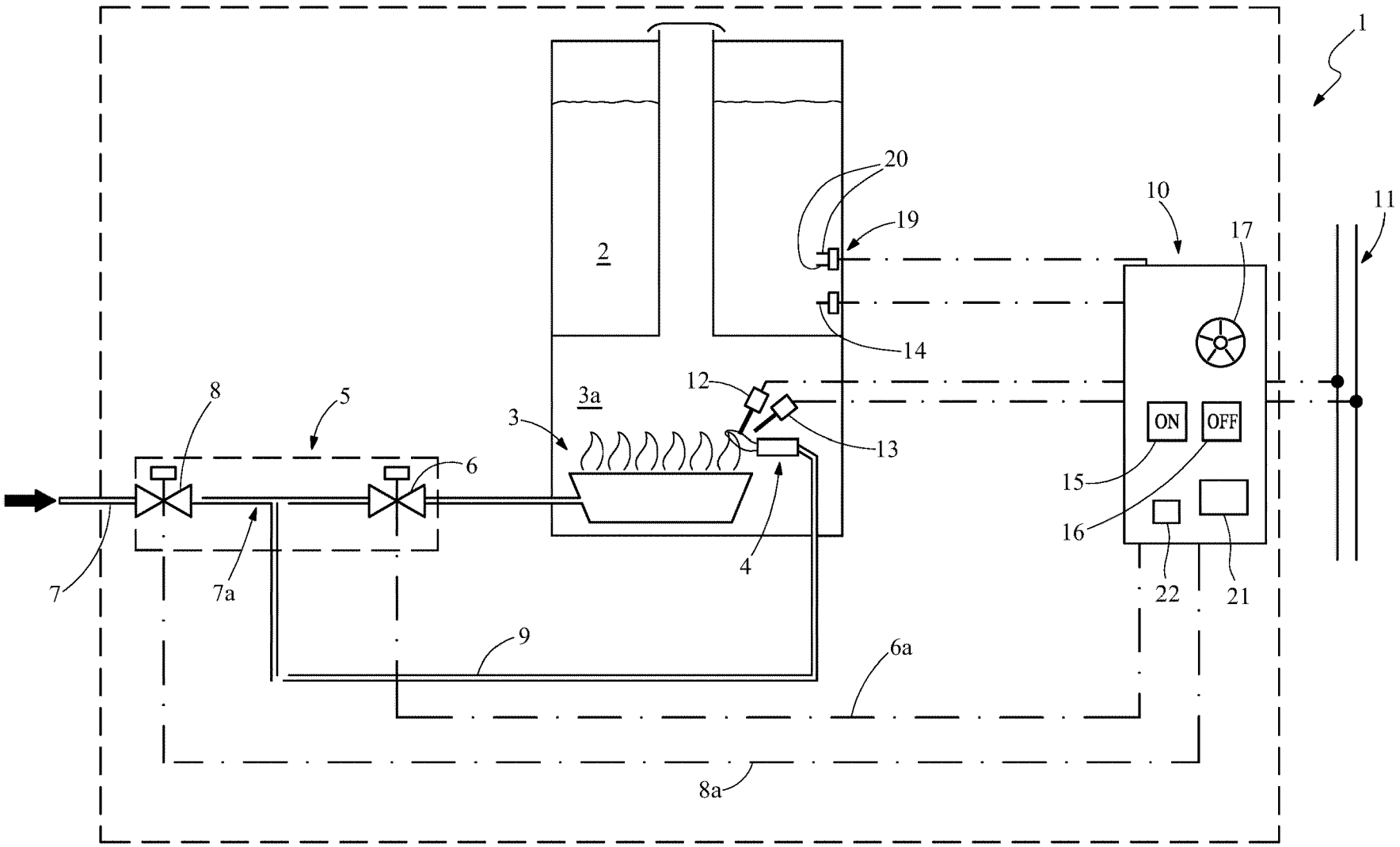
FIG. 1 is a schematic view of the main portions of a heating apparatus with an operational control system according to the present invention.

Initially with reference to FIG. 1, there is generally designated 1 an embodiment of a heating apparatus with a gas burner, which is only schematically illustrated and which is controlled by a system and method for operational control according to the present invention.

The apparatus may be configured, for example, as a heater for sanitary water contained in a storage tank 2 which is also schematically illustrated in FIG. 1.

The apparatus comprises a main burner 3 which is arranged in a combustion chamber 3*a*, in which a main flame is generated, a pilot burner 4 which is suitable for generating a pilot flame for igniting the main burner 3 and a valve group 5.

The pilot burner 4 has an intermittent type control, that is to say, it remains lit only for the time required to ignite the main burner and as long as the main burner is ignited, but, in the event of the main burner being extinguished, the pilot burner is also extinguished.

The valve group 5 comprises a main valve 6 which is arranged on a main pipe 7 of the valve group upstream of the main burner for supplying (opening or intercepting the gas flow) the combustible gas to the main burner 3, and a pilot valve 8 which is arranged on the pipe 7 upstream of the main valve for supplying the gas (opening or intercepting the gas flow) to the pilot burner and towards the main valve.

There is designated 9 a pilot pipe, which branches off from a portion 7*a* of the main pipe 7 which is interposed between the pilot valve 8 and main valve 6 and which is suitable for supplying the gas to the pilot burner 4.

The main valve 6 and the pilot valve 8 are electrical control valves, that is to say, solenoid valves provided with respective actuators which act on the corresponding closure members of the valves and which are energized by supply signals which are carried via respective electric supply circuits 6*a*, 8*a*.

FIG. 1 depicts the circuits 6*a*, 8*a* and other electrical connection portions, away from and towards a control unit 10 of the control system, with a dot-dash line. The supply signals come from the electronic control unit 10, which is advantageously constructed as a printed circuit board and which is operationally associated with the valves 6, 8 in order to allow the passage of gas through the corresponding valve seats. The control unit belongs to the control system of the apparatus which is configured to control the supply of gas to the pilot and main burners.

The control unit 10 is advantageously electrically supplied by means of a connection to the electrical supply network which is designated 11 and which is suitable for supplying, for example, an alternating voltage at a predetermined frequency.

There is designated 12 a flame detection electrode which is placed near the pilot flame and which is operationally connected to the control unit 10.

The electrode 12 is provided to be introduced in a suitable manner into the flame of the pilot burner and is configured to detect and conduct an electric ionization current which is generated by ionization effect produced by the pilot flame.

There is designated 13 a flame discharge/ignition electrode which is also arranged near the pilot burner 4 and which is operationally connected to the control unit 10.

In an embodiment, the functionalities of the electrodes 12 and 13 can be integrated in a single electrode.

There is designated 14 a temperature sensor of an electronic water thermostat which is arranged inside the tank 2 in order to detect the temperature of the water and which is operationally connected to the control unit 10 and which is configured to compare the temperature of the water required by the user (Tset) with the effective temperature detected by the sensor.

In an embodiment, the thermostat can be constructed as a mechanical thermostat having the sensitive portion thereof introduced into the tank and connected to the control unit 10. The thermostat is capable of changing state if the temperature of the water in the tank exceeds the temperature (Tset) required by the user and the control unit is configured to recognize the change of state of the thermostat by intervening with an instruction for extinguishing the main burner. Vice versa, if the temperature detected by the sensor 14 is less than the temperature required (Tset), the corresponding state of the thermostat is detected by the control unit 10 which intervenes with an instruction for igniting the pilot burner and which subsequently, the presence of flame at the pilot being detected, sends the instruction for opening the main valve for igniting the main burner.

With reference to the electronic control unit 10 of the apparatus which is schematically illustrated in FIG. 1, it is operationally associated with an ON push-button, which is designated 15 and with which the unit is activated, bringing about the start of the ignition procedure of the pilot burner, and an OFF push-button, which is designated 16 and with which the user can interrupt the electrical supply of the control unit 10, with a resultant instruction for closing the pilot valve and main valve. There is designated 17 a temperature regulation knob which is only schematically illustrated and with which the user can select the desired temperature (Tset).

There is generally designated 19 an electronic safety device for preventing over-temperatures which is operationally associated with the apparatus and which comprises a pair of thermistor type probes 20 (of the NTC type—Negative Temperature Coefficient) which are connected to the control unit 10 and the respective temperature sensor element of which is positioned inside the tank in a suitable position and introduced into the water contained in the tank itself.

The probes 20 are configured to intervene when a limit temperature designated Tlim (Tlim>Tset) is reached. The provision of a pair of probes serves to perform a redundancy function. During operation of the apparatus, the coherence between the measurements carried out by the probes 20 is controlled continuously by the control unit 10 and the intervention of the safety device 19, in the absence of drifts or faults of the probes, is brought about when both measure a temperature equal to Tlim. In this situation, the control unit 10 sends a closure instruction to the pilot valve 8 and places the system in a blocking condition which places the apparatus out of use, preventing the automatic re-ignition thereof.

According to one of the main aspects of the invention, the control unit 10 is configured to carry out, according to an embodiment, a measurement of the intensity of the ionization current detected in the electrode 12.

In an embodiment, there is provision for the control unit to be configured to detect a variation involving increase or decrease of the ionization current detected in the electrode 12.

During the phenomenon of ionization of the flame, it has been found by the Applicant that the ionization current increases significantly when the main burner is ignited with respect to the value which this current takes on when only the pilot burner is ignited.

Therefore, a variation of the ionization current is generated during the change between a first condition, in which the ionization current is indicative of the effective ignition state of the pilot burner alone, and a second condition, in which the ionization current is indicative of the effective ignition state of the pilot burner and the main burner at the same time, and vice versa.

As a result, the control unit 10, being configured to detect the variation, involving increase or decrease, of the ionization current allows identification of the effective ignition of the main burner, particularly after the main valve has been opened. In this embodiment, the system is made independent of the determination of the absolute value of the ionization current and links the determination of the effective ignition (or extinguishing) of the main burner exclusively with the variations of the ionization current.

In the embodiment which provides for the measurement of the ionization current, the control system is arranged with a suitable current measuring device in order to detect the value of the current intensity, for which there can be recognized both the first ignition condition of the pilot burner alone, which is identified by a first range of values of the intensity of ionization current, and the second ignition condition of the pilot burner and the main burner, which is identified by a second range of values of the intensity of ionization current. In particular, when the first and second ranges of values are different from each other (separate), the system can readily distinguish the effective ignition state of the pilot burner alone from the effective ignition state of the main burner and the pilot burner at the same time.

In FIG. 1, there is schematically indicated 21 the circuit complex of the control unit 10 which operates with the function of measuring the intensity of ionization current or with the function of detecting the variations of the ionization current, independently of the absolute value thereof.

Figure 2:
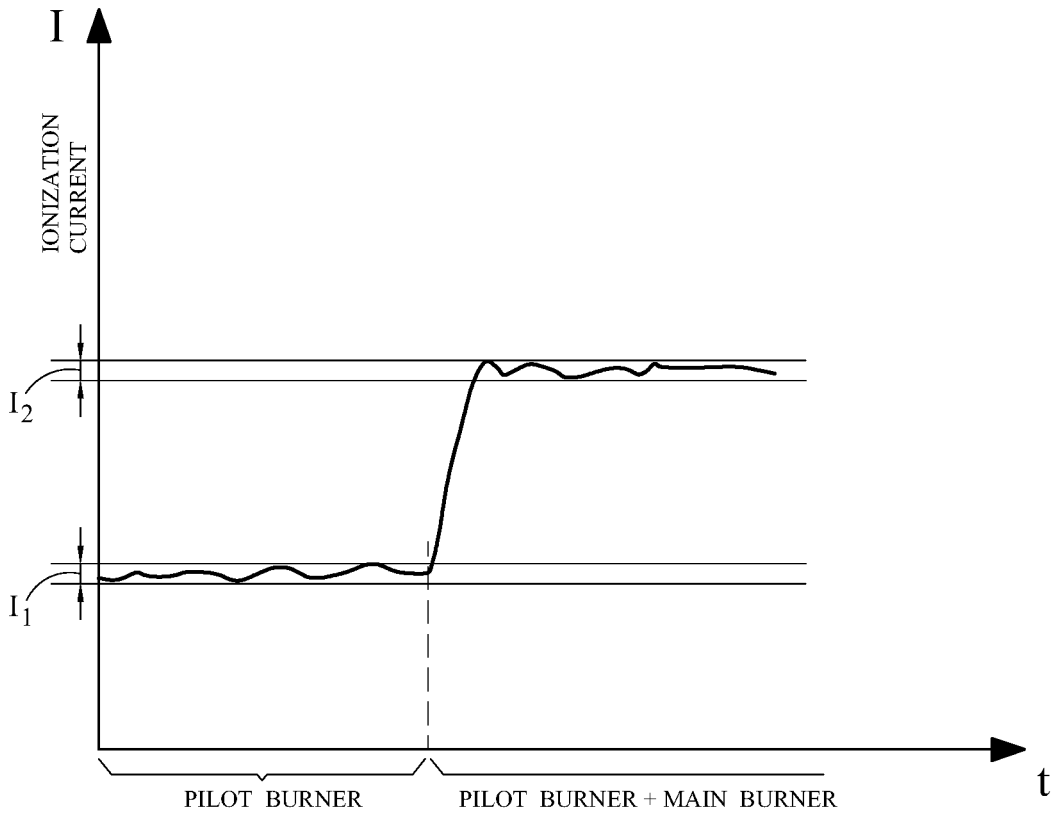
FIG. 2 is a view of a diagram, which schematically shows the progression of the ionization current detected in the operating steps of the burner of the apparatus of FIG. 1, FIGS. 3 and 4 are views of respective block diagrams with reference to corresponding logical configurations for operational control of the control system of the apparatus of FIG. 1.

FIG. 2 shows in a diagram (ionization current I-time t of ignition of burners) the qualitative progression of the ionization current detected in the presence of ignition of the pilot burner alone, to which there corresponds a first range I1 of current values, and in the presence of simultaneous ignition of the pilot burner and main burner, to which there corresponds a second range I2 of current values, the ranges I1 and I2 being separate from each other with the values of the range I2 being greater than the values of the range I1.

By measuring the ionization current or by determining variations of the ionization current, therefore, it is possible using a single flame electrode 12 to detect the effective ignition of the pilot burner 4 and the main burner 3, with advantageous containment of the costs with respect to a solution in which there is provision for using a second additional electrode which is associated with the flame detector in order to determine the effective ignition of the main burner.

Figure 3:
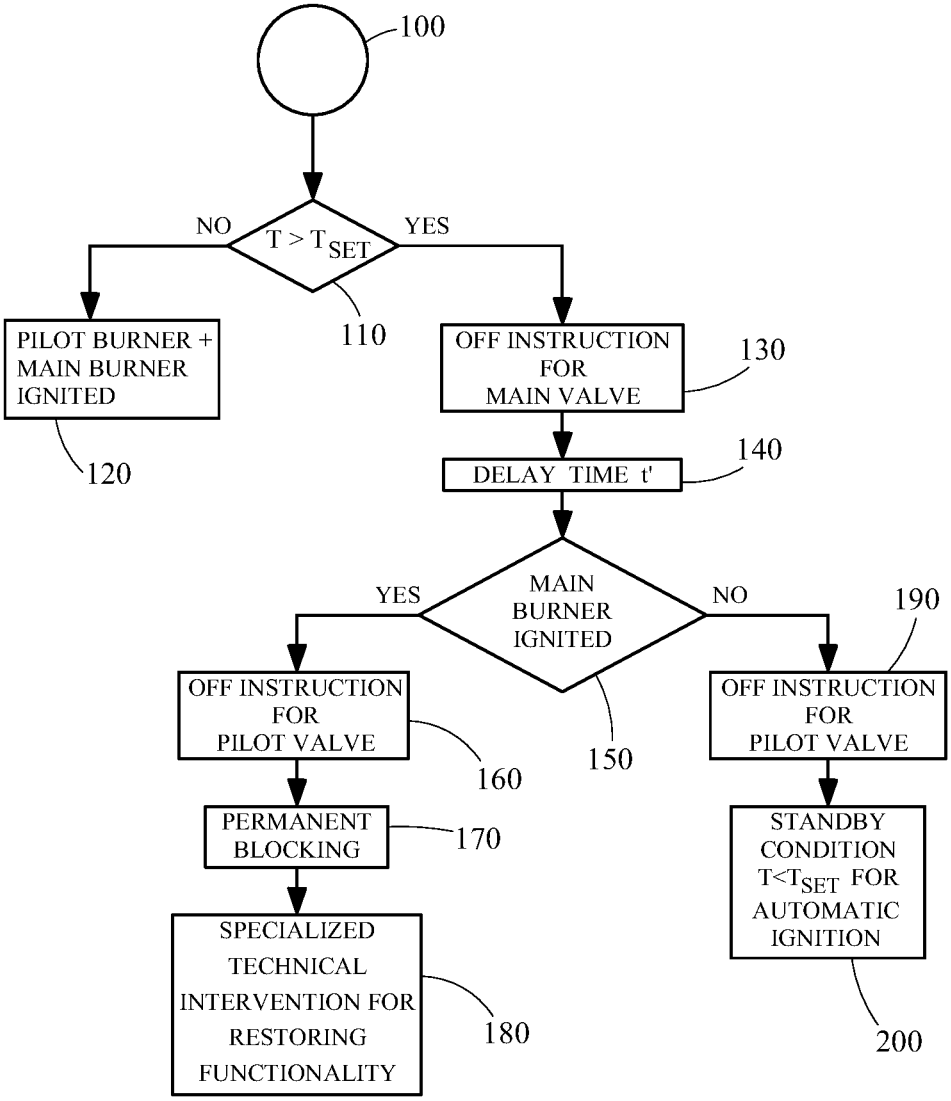

Determining the effective ignition state of the main burner carried out by means of the control system of the invention with the operating methods described above is found to be particularly effective in managing a number of problems involving faults and to distinguish possible malfunction conditions of the heater apparatus. The block diagram of FIG. 3 illustrates the sequence of operating steps which are provided by the system and the method for operational control for controlling a number of examples of these conditions and which are described below in greater detail.

A malfunction situation may, for example, occur if a fault of the main valve 6, which prevents the closure thereof, occurs.

Starting from an operating condition, in which both the pilot burner 4 and main burner 3 are both ignited, because the temperature T of the water measured is less than the temperature required Tset (T<Tset), when the temperature reaches the value required (T=Tset), the control unit 10 sends the closure instruction to the main valve 6 and to the pilot valve 8. Therefore, it is assumed that the main valve 6 does not close as a result of the above-mentioned fault, while the pilot valve 8 closes correctly and the closure of the pilot valve completely interrupts the gas flow.

When, subsequently, the temperature of the water then becomes less than the temperature required again (T<Tset), the control unit 10 sends the instruction for opening to the pilot valve 8, but, the main valve 6 being open as a result of the fault, the gas flow reaches both the pilot burner and the main burner, with the risk of explosion when the flame at the pilot burner is triggered.

According to the invention the control system is configured to introduce a delay time, designated t', between the closure instruction sent to the main valve 6 and the closure instruction sent to the pilot valve 8. This delay time t' can be sent by means of a timer circuit which is operationally associated with or implemented in the control unit 10, and is advantageously selected to be in the order of a few seconds, for example, preferably less than 10 seconds, and, in a further preferred manner, to have values equal to approximately 5 seconds. There is schematically designated 22 the timer circuit which is implemented in the control printed circuit board.

In this time period t', which passes between the instruction for closing the main valve 6 and the instruction for closing the pilot valve 8, the pilot burner 4 is therefore ignited. Assuming that the main valve 6, as a result of the fault, remains open, the main burner 3 remains ignited despite the closure instruction sent and the electrode 12 consequently does not detect any reduction of the ionization current (which reduction would otherwise have to be detected after the closure instruction is sent). This reduction of ionization current not being detected, the delay time t' having passed, the control unit 10 is configured to send an instruction for closing the pilot valve 8 and to place the apparatus in a permanent blocking condition so as to prevent re-ignition thereof by means of the thermostat even if the detected temperature is less than the temperature required (T<Tset). From this blocking condition, the functionality of the apparatus can, for example, be restored only by the intervention of a qualified operator.

The sequence of operating steps of the apparatus which is carried out during the management of this hypothesis involving a possible fault in the main valve is schematically illustrated in the block diagram of FIG. 3, with particular reference to the blocks from 130 to 180. The starting block 100 refers to a normal operating condition with a main burner and pilot burner which are both ignited (with T<Tset).

With reference to the block 110, as long as the temperature T measured by the sensor 14 is less than Tset, the pilot burner and main burner continue to operate (block 120) while, if the measured temperature reaches and exceeds the temperature required (T>Tset), the instruction for closing the main valve 6 is sent (block 130) and the timer unit 22 is started in order to count the delay time t' (block 140). In this time t', the ionization current is detected by the control unit and if, the time t' having passed (block 150), there is not detected any decrease in the ionization current, this condition detects that the main burner is still ignited in spite of the extinguishing instruction sent beforehand. Consequently, the instruction for closing the pilot valve is sent (block 160) and the system is placed in the permanent blocking condition described above (block 170). The blocking condition is configured so that the re-ignition of the apparatus can be brought about only with the intervention of a qualified person who restores the system by resolving the fault situation (block 180).

Naturally, it will be understood that if, during the delay time t', there is detected a reduction of the ionization current, which condition identifies the occurrence of extinguishing of the main burner by means of the correct closure of the main valve, the subsequent instruction for closure of the pilot valve (block 190) also extinguishes the pilot burner and the system can subsequently be re-ignited automatically (without any manual intervention of the user), in the normal ignition procedure instructed by the thermostat (block 200).

By recognizing the effective ignition of the main burner 3, which can be brought about with the present invention, it is also possible to control and manage other conditions involving possible malfunctions which can occur during use of the apparatus, as specified in greater detail below, with particular reference to the block diagram of FIG. 4.

During the operation of the apparatus, reaching the limit temperature Tlim may be a result of the presence of transient temperatures caused by stratifications present in the storage tank 2 (connected with the presence of zones of the tank which are characterized by residues or deposits which tend to trap the water, with the resultant development of transient temperatures greater than in those zones with respect to others), or it may be a result of the incorrect closure of the main valve as a result of a fault thereof, as described above.

In the first case, that is to say, in the presence of a temporary increase of the temperature in the tank as a result of the stratifications, the system of the invention, as a result of the capacity for recognizing the state of effective ignition of the main burner by means of the ionization current, is found to be an additional aid in distinguishing a possible temporary stratification condition with respect to a real problem of over-temperature.

Figure 4:
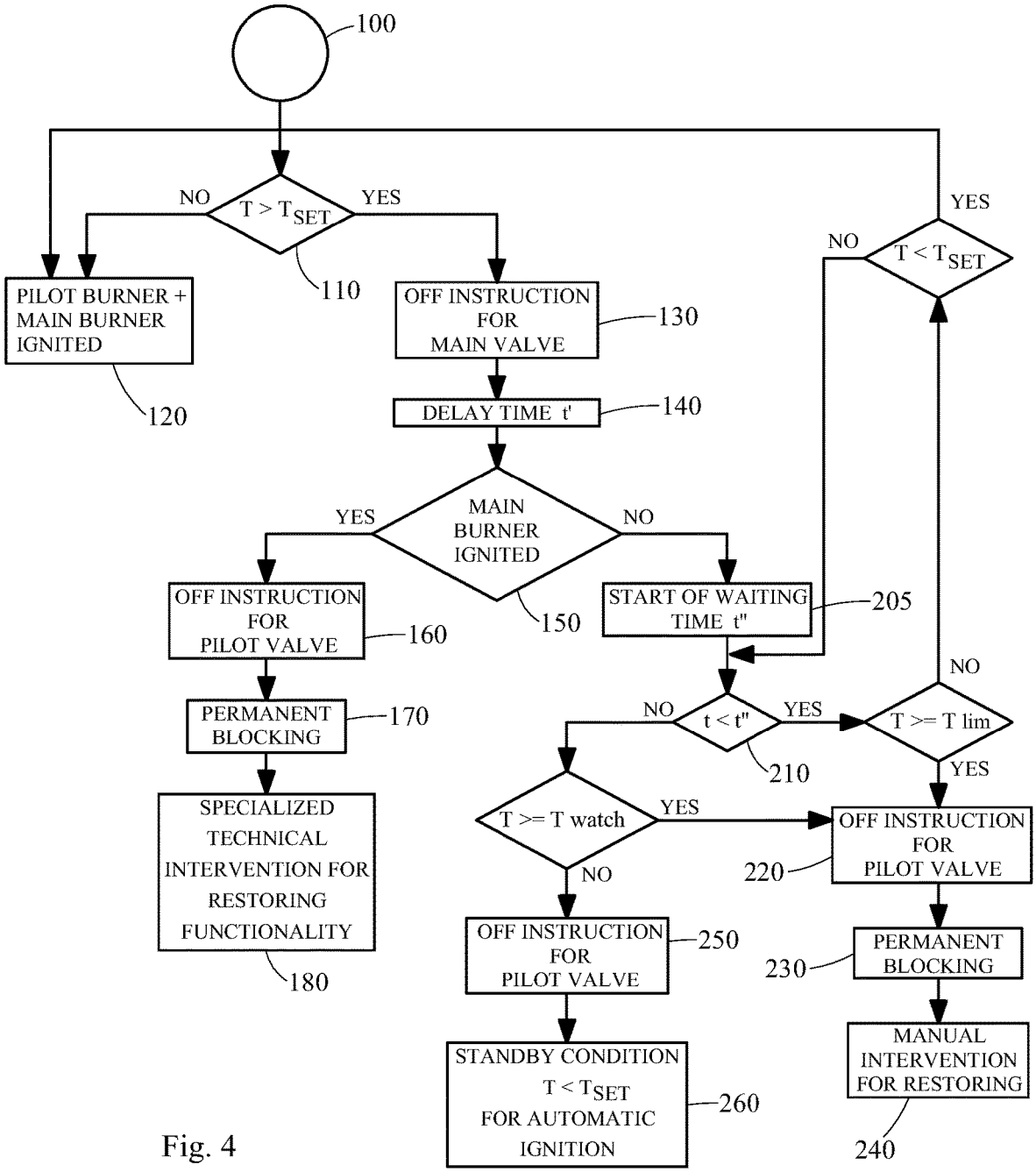

With reference to FIG. 4, assuming the situation in which the instruction for closing has been sent to the main valve (block 130) because the temperature T measured has reached the value Tset, after starting the timer unit for counting the delay time t' (block 140), the following sequence can be established:

a) if, during the time t', the ionization current starts to decrease, the control unit 10 by measuring the ionization current recognizes the effective extinguishing of the main burner (block 150), b) the continuous monitoring of the temperature by the probes 20 can indicate that the temperature measured is greater than the temperature required Tset (T>Tset), c) when the conditions a) and b) are fulfilled at the end of the delay time t', the control unit 10 again brings about the start of the timer unit in order to count a waiting time, designated t" (block 205).

In this sequence, therefore, when both the above-mentioned conditions a) and b) are fulfilled, there is not sent to the pilot burner any extinguishing instruction (or no instruction for closing the pilot valve is sent by the control unit). Therefore, the pilot burner remains ignited and the counting of the waiting time t" is started by the timer unit.

During the waiting time t", the temperature T measured by the probes can take on the following values (block 210):

it can be between Tset and a watch temperature Tgua (Tset<T<Tgua), where Tgua is a temperature between Tset and Tlim;

it can be greater than Tlim (T>Tlim), it can be less than Tset (T<Tset), it can be between Tgua and Tlim (Tgua<T<Tlim).

During the waiting time t", the control unit 10 is configured to act in the following manner:

if the temperature T measured is greater than or equal to the limit temperature (T>=Tlim), there is immediately sent (without waiting for the end of the waiting time) a closure instruction to the pilot valve (block 220) and the apparatus is placed in a permanent blocking condition and operation is prevented (block 230). The normal functionality can be restored with a special restoring procedure (block 240) of the manual type. This special restoring procedure (block 240) of the manual type can be carried out by the user or by a qualified person. This blocking configuration is configured as in the blocking procedure provided by the intervention of the safety device 19 to prevent over-temperatures, if the temperature T measured is less than Tset (T<Tset), the pilot burner is left lit and the procedure for automatic ignition of the main burner controlled by the thermostat is started (the control unit sends an instruction for opening the main valve and subsequently resets the counting of the delay time in order to evaluate the increase of the ionization current).

At the end of the waiting time t", the control unit 10 is configured to act in each of the situations set out in the following manner:

if the temperature T measured is between the watch temperature Tgua and the limit temperature Tlim (Tgua<T<Tlim), there is sent a closure instruction to the pilot valve (block 220) and the apparatus is placed in a blocking condition (block 230). The normal functionality can be restored with a special restoring procedure (block 240) of the manual type. This special restoring procedure (block 240) of the manual type can be carried out by the user or by a qualified person, if the temperature T measured is between the temperature required Tset and the watch temperature Tgua (Tset<T<Tgua), a closure instruction is sent to the pilot valve (block 250) and the apparatus is placed in a standby condition (block 260). This standby condition is the condition for which it is expected that the temperature T decreases below Tset in order to start the automatic ignition procedure of the pilot burner and main burner.

Preferred values of the waiting time t" are in the order of tens of minutes, preferably less than 15 minutes.

With the operating control steps set out above, it is therefore possible to recognize whether there is involved a temporary increase in the temperature of the water in the tank as a result of the above-mentioned phenomenon (as a result of the stratifications in the tank), therefore without any real fault situation, or whether there is involved a malfunction resulting from an effective fault of the apparatus which requires the correct functionality to be restored.

The invention thereby achieves the predetermined objects while affording the advantages mentioned above with respect to the known solutions.

The invention claimed is:

1. A control system for operational control of a water heater apparatus with a combustible gas burner, the apparatus comprising:

a pilot burner (4) for generating a pilot flame, a main burner (3) for generating a main flame, a valve group comprising a pilot valve (8) upstream of the pilot burner (4) in order to open/intercept a direct flow of gas to the pilot burner and to a main valve, the main valve (6) being positioned upstream of the main burner in order to open/intercept a direct flow of gas to the main burner, the pilot valve and main valve being electrical control valves, the pilot burner (4) being controlled as a burner with an intermittent-type pilot flame, the control system comprising a control unit (10) configured to operationally control the pilot valve (8) and main valve (6), a flame detection electrode (12) which is provided to be introduced into the flame of the pilot burner (4) and which is configured to conduct an ionization current which is generated by ionizing effect produced by the flame, wherein the control unit (10) is configured to carry out a measurement or to detect a variation involving increase or decrease of ionization current intensity detected in the flame detection electrode (12), the variation in the ionization current intensity being generated during a change between a first condition, in which the ionization current is indicative of an ignition state of only the pilot burner (4), and a second condition, in which the ionization current is indicative of a simultaneous ignition state of the pilot burner (4) and the main burner (3) so that, by the detection of the measurement or the variation of ionization current, an effective ignition of the main burner (3) is recognized, and wherein the control unit (10) is configured to introduce a delay time (t') between an instruction to close the main valve (6) and an instruction to close the pilot valve (8), during the delay time (t') the ionization current being measured or a variation of the ionization current being detected in order to identify an effective extinguishing of the main burner (3).

2. The control system according to claim 1, further comprising at least one temperature probe (20) for measuring a temperature (T) of heated water in a tank (2) of the apparatus and the control unit (10) is configured to further introduce a waiting time (t"), at the expiry of the delay time (t'), if, during the delay time (t'), the following conditions are fulfilled:

the ionization current tends to decrease, the control unit identifies the effective extinguishing of the main burner (3) and the temperature (T) measured by the at least one probe (20) is greater than a heating temperature (Tset) which is required for the heated water of the tank, the control unit (10) being configured to operate in the following manner, during the waiting time (t"):

send a closure instruction to the pilot valve (8), if the temperature (T) measured is greater than or equal to a limit temperature (Tlim) in which the limit temperature (Tlim) is greater than the heating temperature required (Tset), placing the apparatus in a permanent blocking condition with operation being prevented, a normal functionality being able to be restored with a special restoring procedure manually carried out by a user or by qualified operators, start an automatic ignition procedure of the main burner if the temperature (T) measured is less than the heating temperature required (Tset), leaving on the pilot burner (4).

3. The control system according to claim 2, wherein the control unit (10) is configured to operate in the following manner at the end of the waiting time (t"):

send a closure instruction to the pilot valve if the temperature (T) measured is between a watch temperature (Tgua) and the limit temperature (Tlim) in which the watch temperature (Tgua) is selected between the limit temperature (Tlim) and the heating temperature required (Tset), placing the apparatus is placed in a blocking condition, a normal functionality being able to be restored with the special restoring procedure manually carried out by the user or by the qualified operators, send a closure instruction to the pilot valve (8) if the temperature (T) measured is between the heating temperature required (Tset) and the watch temperature (Tgua), placing the apparatus in a standby condition, in which the apparatus waits for the temperature in the tank to decrease below the heating temperature required (Tset) in order to start the automatic ignition procedure of the main burner and an automatic ignition of the pilot burner.

4. A control system for operational control of a water heater apparatus with a combustible gas burner, the apparatus comprising:

a pilot burner (4) for generating a pilot flame, a main burner (3) for generating a main flame, a valve group comprising a pilot valve (8) upstream of the pilot burner (4) in order to open/intercept a direct flow of gas to the pilot burner and to a main valve, the main valve (6) being positioned upstream of the main burner in order to open/intercept a direct flow of gas to the main burner, the pilot valve and main valve being electrical control valves, the pilot burner (4) being controlled as a burner with an intermittent-type pilot flame, the control system comprising a control unit (10) configured to operationally control the pilot valve (8) and main valve (6), a flame detection electrode (12) which is provided to be introduced into the flame of the pilot burner (4) and which is configured to conduct an ionization current which is generated by ionizing effect produced by the flame, wherein the control unit (10) is configured to carry out a measurement or to detect a variation involving increase or decrease of ionization current intensity detected in the flame detection electrode (12), the variation in intensity of the ionization current intensity being generated during a change between a first condition, in which the ionization current is indicative of an ignition state of only the pilot burner (4), and a second condition, in which the ionization current is indicative of a simultaneous ignition state of the pilot burner (4) and the main burner (3) so that, by the detection of the measurement or the variation of ionization current, an effective ignition of the main burner (3) is recognized, and wherein the control unit (10) is configured to detect the measurement of the ionization current intensity in order to recognize the first condition of only the pilot burner (4) identified by a first range (I1) of values of the ionization current intensity and the second condition of the pilot burner (4) and the main burner (3) identified by a second range (I2) of values of the ionization current intensity, the first and second ranges (I1, I2) being mutually different so that a state of effective ignition of only the pilot burner (4) can be distinguished from the simultaneous ignition state of the main burner (3) and the pilot burner.

5. A water heater apparatus with a combustible gas burner, the apparatus comprising:

a pilot burner (4) for generating a pilot flame, a main burner (3) for generating a main flame, a valve group comprising a pilot valve (8) upstream of the pilot burner (4) in order to open/intercept a direct flow of gas to the pilot burner and to a main valve (6), the main valve being positioned upstream of the main burner (3) in order to open/intercept a direct flow of gas to the main burner, the pilot valve and main valve being electrical control valves, the pilot burner (4) being controlled as a burner with a pilot flame of the intermittent type, and the control system according to claim 1.

6. A method for operationally controlling a water heater apparatus with a combustible gas burner, the apparatus comprising:

a pilot burner (4) for generating a pilot flame, a main burner (3) for generating a main flame, a valve group comprising a pilot valve (8) upstream of the pilot burner (4) in order to open/intercept a direct flow of gas to the pilot burner and to a main valve (6), the main valve being positioned upstream of the main burner (3) in order to open/intercept a direct flow of gas to the main burner, the pilot valve and main valve being electrical control valves, the pilot burner (4) being controlled as a burner with a pilot flame of the intermittent type, a control system comprising a control unit (10) which is operationally associated with the pilot valve (8) and main valve (6) for the operational control thereof, a flame detection electrode (12) which is introduced into the flame of the pilot burner and which is configured to conduct an ionization current which is generated by ionizing effect produced by the flame, wherein the method comprises:

carrying out a measurement or detecting a variation involving increase or decrease of the ionization current intensity detected in the electrode (12), the variation in intensity of ionization current being generated during a change between a first condition, in which the ionization current is indicative of the ignition state of only the pilot burner (4), and a second condition, in which the ionization current is indicative of a simultaneous ignition state of the pilot burner (4) and the main burner (3) so that by the detection of the measurement or the variation of control unit, an effective ignition of the main burner (3) is recognized; and introducing a delay time (t') between a closure instruction sent to the main valve (6) and a closure instruction sent to the pilot valve (8), during the delay time (t') the ionization current being measured or a variation of the ionization current being detected in order to identify the effective extinguishing of the main burner (3).

7. The method according to claim 6, further comprising:

detecting the intensity measurement of the ionization current in order to recognize the first condition of only the pilot burner (4) identified by a first range (I1) of values of the ionization current intensity and the second condition of the pilot burner and the main burner identified by a second range (I2) of values of the ionization current intensity, the first and second ranges (I1, I2) being mutually different so that a state of effective ignition of only the pilot burner (4) is distinguished from the simultaneous ignition state of the main burner (3) and the pilot burner.

8. The method according to claim 6, wherein the apparatus further comprises at least one temperature probe (20) for measuring a temperature of heated water in a tank (2) and wherein the method further comprises: introducing a further waiting time (t"), at the expiry of the delay time (t'), if, during the delay time (t'), the following conditions are fulfilled:

the ionization current tends to decrease, identifying the effective extinguishing of the main burner (3) and the temperature (T) measured by the at least one probe (20) is greater than a heating temperature (Tset) which is required for the heated water of the tank, the method providing for the following operating steps during the waiting time (t"):

sending a closure instruction to the pilot valve (8) if the temperature (T) measured is greater than or equal to a limit temperature (Tlim) in which the limit temperature (Tlim) is greater than the heating temperature required (Tset), placing the apparatus in a permanent blocking condition with operation being prevented, a normal functionality being able to be restored with a special restoring procedure manually carried out by a user or by qualified operators, leaving on the pilot burner (4) and starting the automatic ignition procedure of the main burner if the temperature (T) measured is less than the heating temperature required (Tset).

9. The method according to claim 8, further comprising the following operating steps at the end of the waiting time (t"):

sending a closure instruction to the pilot valve (8) if the temperature (T) measured is between a watch temperature (Tgua) and the limit temperature (Tlim) in which the watch temperature (Tgua) is selected between the limit temperature (Tlim) and the heating temperature required (Tset), placing the apparatus in a blocking condition, the normal functionality being able to be restored with the special restoring procedure manually carried out by the user or by the qualified operators, if the temperature (T) measured is between the heating temperature required (Tset) and the watch temperature (Tgua), a closure instruction is sent to the pilot valve (8) and the apparatus is placed in a standby condition, waiting for the temperature in the tank to decrease below the heating temperature required (Tset) in order to start the automatic ignition procedure of the main burner and an automatic ignition procedure of the pilot burner.

10. The method according to claim 8, wherein the at least one temperature probe includes two temperature probes (20) configured as a safety device (19) with redundancy against over-temperature, wherein the two temperature probes each comprise a thermistor.

* * * * *